US005842077A

United States Patent [19]

Zangenfeind et al.

[11] Patent Number: 5,842,077

[45] Date of Patent: Nov. 24, 1998

[54] DEVICE FOR THE AUTOMATIC REMOVAL OF A PHOTOGRAPHIC FILM FROM A CARTRIDGE

[75] Inventors: Helmut Zangenfeind, Puchheim; Jürgen Brunner; Reinhart Wuerfel, both of München; Günther Dömges, Oberhaching; Raimund Kugel, Dennweiler-Frohnbach, all of Germany

[73] Assignee: AGFA-Gevaert Aktiengesellschaft, Leverkusen, Germany

[21] Appl. No.: 738,676

[22] Filed: Oct. 25, 1996

[30] Foreign Application Priority Data

Oct. 25, 1995 [DE] Germany ..... 195 39 718.5

[51] Int. Cl.[6] ..... G03D 3/08; G03D 13/08

[52] U.S. Cl. ..... 396/647; 396/612

[58] Field of Search ..... 396/2, 589, 594, 396/598, 612, 620, 617, 622, 626; 414/411, 403, 417; 221/172, 290; 193/43–48; 209/546, 598; 352/123

[56] References Cited

U.S. PATENT DOCUMENTS

| | | | |
|---|---|---|---|
| 3,851,957 | 12/1974 | Anderson | 352/123 |
| 4,089,017 | 5/1978 | Buldini | 396/2 |
| 4,091,397 | 5/1978 | Gulbrandsen | 396/2 |
| 4,732,278 | 3/1988 | Zangenfeind et al. | 209/546 |

*Primary Examiner*—D. Rutledge
*Attorney, Agent, or Firm*—Furgang & Milde, LLP

[57] ABSTRACT

A device for the automatic removal of a photographic film from a cartridge in which the film has been wound onto a spool. A guide opening for the cartridge has a cross-section which allows the receiving of the cartridge in only one orientation is provided so that the cartridge moves through the opening in the direction of its spool axis by its own weight. A system for simultaneously linearly displacing and rotating the axis of the spool is provided, to rotate the spool axis from vertical to horizontal and to reposition the cartridge for unwinding the film from the spool. The system holds the cartridge in a spool receptacle, and repositions and rotates the cartridge with a single actuator.

17 Claims, 3 Drawing Sheets

DEVICE FOR THE AUTOMATIC REMOVAL OF A PHOTOGRAPHIC FILM FROM A CARTRIDGE

FIELD OF THE INVENTION

The invention relates to the field of devices for the automatic removal of a photographic film from a cartridge, and more particularly to devices for the handling film cartridges in which a spool of wound film is stored, each having a longitudinal spool axis, down a feed channel of the device that is oriented so that the cartridge moves through the channel in the direction of its longitudinal axis by its own weight, with the guide having a cross section that conforms to the shape of the cartridge, and a mechanism for turning the cartridge from a position in which the spool axis is aligned approximately vertically into a position in which the spool axis is aligned approximately horizontally.

BACKGROUND OF THE INVENTION

In processing photographic films in a large laboratory, the films are removed from the film cartridges in a so-called splicer, and glued together into a long strip. In this case, the rear end of each film and the front end of the following film are positioned in a splicing station in such a way that the ends can be joined together by means of a splicing label. A device of this type is described, for example, in EP 0,212 134.

U.S. Pat. No. 4,732,278 describes a splicer which provides a drop shaft cartridge feed mechanism which is inclined at least 45° to the horizontal, having a deposit opening which is configured in such a way that the film cartridge can have only a single relative position as it moves through the drop shaft. A tipping station is provided in the drop shaft which brings the film cartridge from a vertical into a horizontal position. The film cartridge is then moved into the removal station with this horizontal orientation.

In a subsequent splicer design, a rotating drum is provided below the deposit opening, the axis of rotation of which runs perpendicular to the longitudinal axis of the cartridge which has been dropped in. Inside the drum, a receiving chamber for the film cartridge is provided. When the drum is turned 90°, the receiving chamber with the cartridge inside is brought into a horizontal position. While in this position, the cartridge is pushed sideways, out of the chamber, by a sliding bar and is grasped by a pair of pincers. The latter then move the cartridge to the removal station.

At least three driving means are required in this rotating drum splicer for transporting the film cartridge from the deposit opening to the removal station. In this regard, the first driving means is needed for turning the drum, the second for actuating the sliding bar, and the third for moving the pincers from the film cartridge receiving position to the removal station. This construction is expensive, and is susceptible to problems as a result of the multiplicity of transfers from one device to the next.

SUMMARY OF THE INVENTION

The present invention therefore provides a transport mechanism for a film cartridge within a splicer, for moving a film cartridge from the deposit opening to the removal station in such a way that, as far as possible, only one driving means is needed, with a corresponding elimination of the need for the many error-prone cartridge transfers.

The present invention therefore employs a mechanism for linearly displacing and rotating the cartridge from a vertical to horizontal orientation simultaneously.

A single cartridge receptacle, initially located under the deposit opening, moves all the way to the removal station along with the cartridge, and therefore the cartridge can remain in this receptacle and does not have to be transferred to additional transport or turning devices. As a result, the mechanism is simplified, a single drive employed, and cartridge transfers eliminated.

The cartridge receptacle is preferably disposed in a tube in such a way that in one end position, it is in a vertical position for receiving the cartridge, and at the other end position it is in a horizontal position. The tube is provided with sliding slots or grooves whose position on the tube wall turns by 90° from one end of the tube to the other, forming a helical cam. Pegs, or cam followers, which are affixed to the cartridge receptacle, slide in these sliding slots, thus ensuring simultaneous linear and rotational movement.

For manufacturing engineering reasons, it is advantageous to design the sliding slots as openings through the full thickness of the tube wall. In order to be able to make the tube light-tight in spite of these apertures, a second, enclosed tube with a somewhat larger diameter is slipped over the guide tube, providing a composite structure having partial thickness grooves on the inner wall and a light tight construction.

In order that the removal station in the interior of the device can be kept light-tight at all times, there is provided within the tube a sealing slide which is mounted in such a way that it is between the cartridge receptacle and the removal station when the cartridge receptacle is positioned in its receiving position. An additional light-tight seal is located between the deposit opening and the cartridge receptacle in its receiving position. In this way, a light-trap function is assured because there is always a closed sealing slide between the daylight outside the housing and the removal station inside the housing. In this configuration, the cartridge feed mechanism outside the light trap need not be darkened.

It is therefore an object of the invention to provide a device for the handling of a film cartridge having a spool axis, with a guide having a cross section which corresponds to a shape of the cartridge, which is arranged in such a way that the cartridge moves by means of its own weight in the direction of its spool axis, having a mechanism for turning the cartridge from a position in which the spool axis is aligned approximately vertically into a position in which the spool axis is aligned approximately horizontally, the mechanism for turning the cartridge comprising a cartridge receptacle which can be linearly displaced and rotated simultaneously by an actuator.

It is also an object of the invention to provide a film handling device in which the cartridge receptacle is guided within a tube between a receiving position and a position for handling the cartridge. The cartridge receptacle preferably moves along the axis of the tube.

It is a further object of the invention to provide a film handling device in which a helical cam structure rotationally reorients the cartridge simultaneously with a movement along an axis of the tube. The cartridge receptacle is preferably provided with slidable pegs which are guided in corresponding groove guides in the wall of the tube.

It is a still further object of the invention to provide a film handling device having a helical cam structure with a composite wall formed of an inner shell having a full thickness groove formed therein and an outer shell preventing light from entering through the grooves.

It is another object of the invention to provide a film handling device having a tube which, at one end has a selective seal which can be moved into an open position and a closed, light-tight position.

It is still another object of the invention to provide a film handling device having a tube, with a cartridge receptacle inside the tube having a receiving position, the tube having an aperture above the receiving position for admitting a film cartridge and which is selectively sealable in a light-tight manner.

These and other objects and features of the present invention will become more fully apparent from the following description and appended claims taken in conjunction with the accompanying drawings, in which like numerals refer to like parts.

DETAILED DESCRIPTION OF THE PREFERRED EMBODIMENTS

Figure 1:
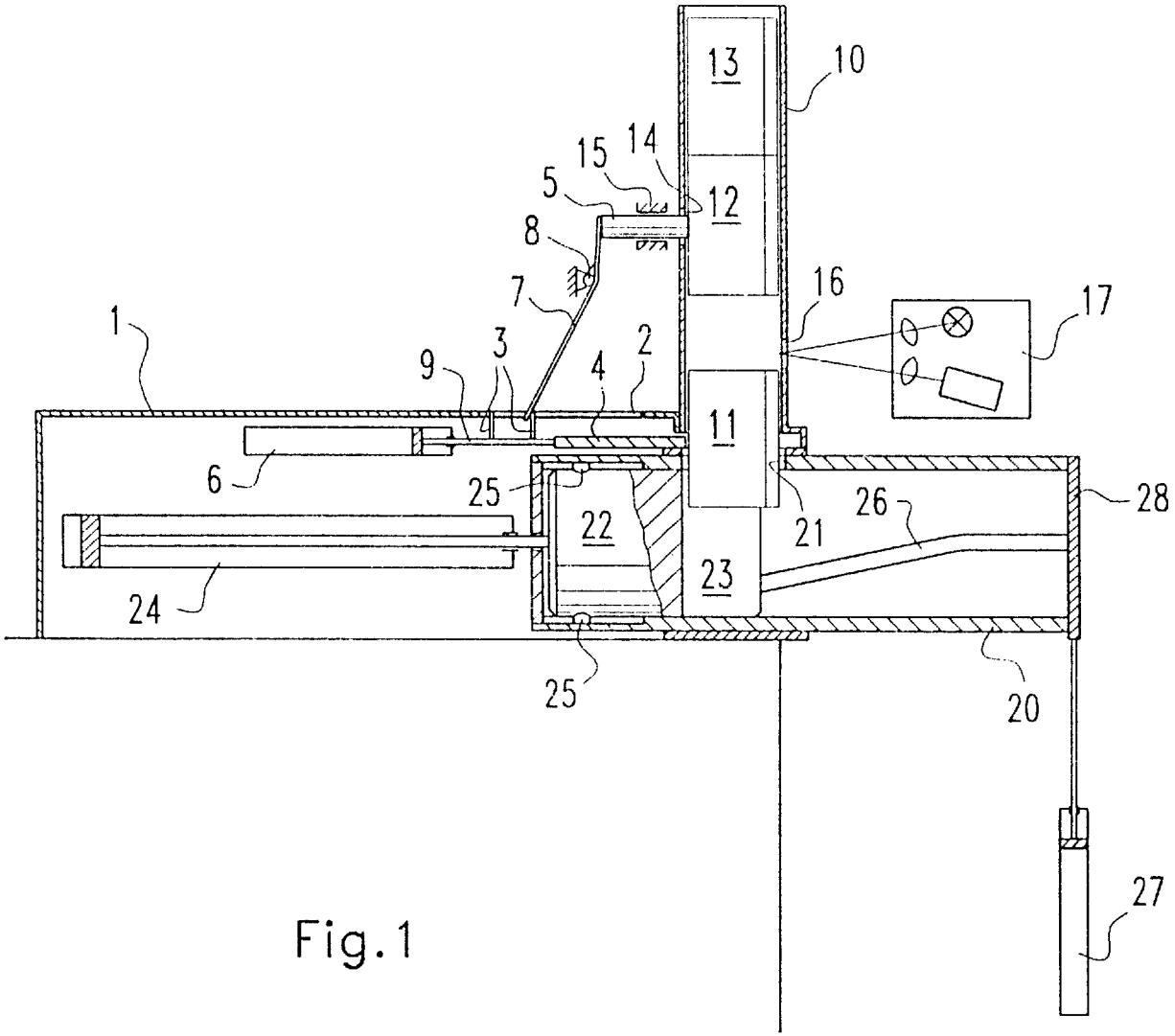
FIG. 1 shows a side view of an embodiment of the present invention with the cartridge receptacle being filled.

The invention will now be described by way of the drawings, in which corresponding reference numerals indicate corresponding structures in the figures.

FIG. 1 shows a preferred embodiment of the invention, in which a clamping stamp 5 and a locking slide 4 are coupled to each other, so that they are moved together by a pneumatic cylinder 6. A leaf spring 7 is provided linking the locking slide 4 and the clamping stamp 5. The leaf spring 7 is pivotally supported by a housing by support 8, and rotates about this support 8. The shorter lever arm of leaf spring 7 is attached to the clamping stamp 5. The longer of the lever arms projects through an opening 2 of the upper housing cover 1 between two cams 3. These cams 3 are attached to a connecting rod 9 between the locking slide 4 and the pneumatic cylinder 6.

Figure 2:
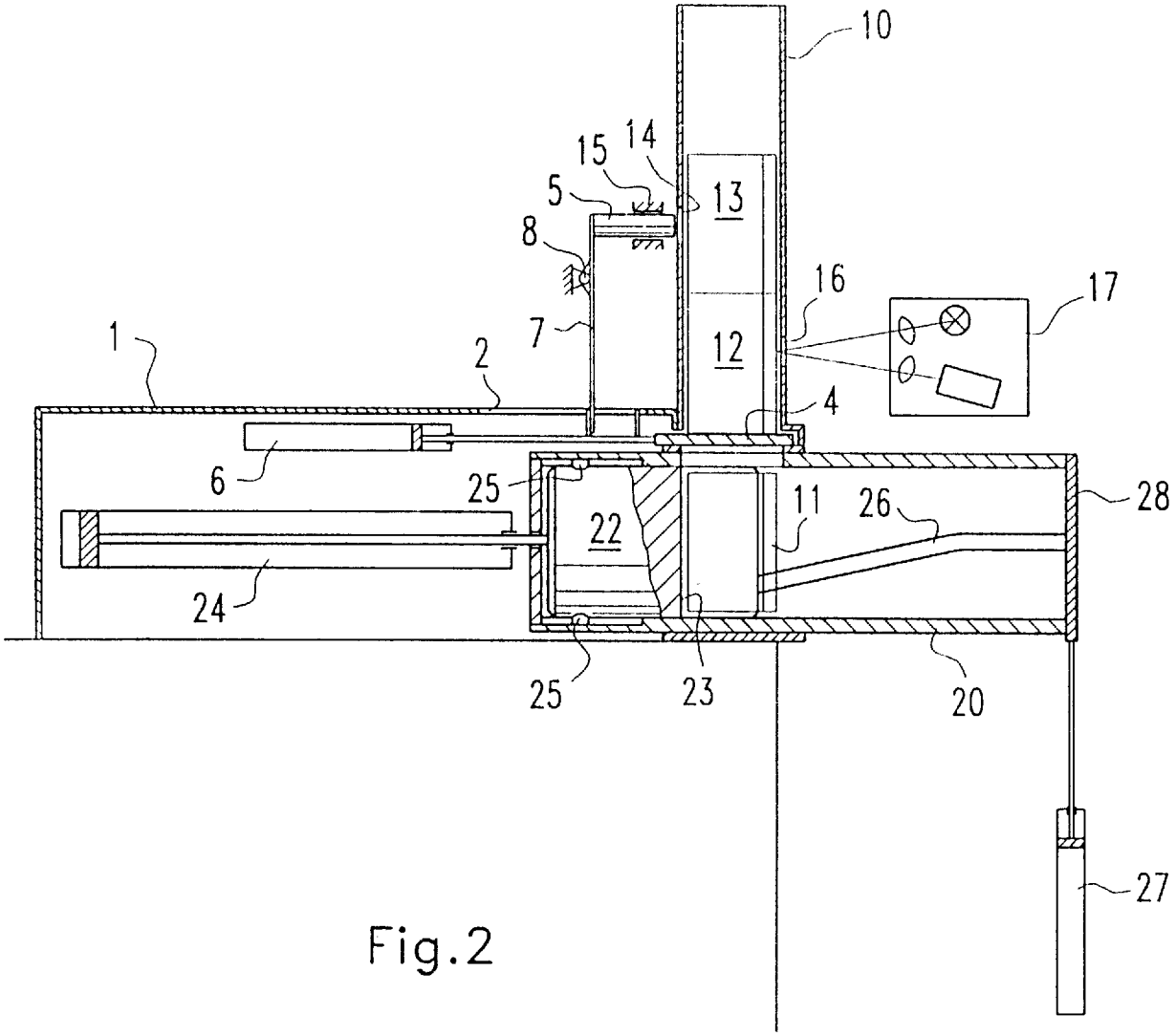
FIG. 2 shows a side view of the device in accordance with FIG. 1, with a cartridge in the cartridge receptacle, which is in its receiving position.
Figure 3:
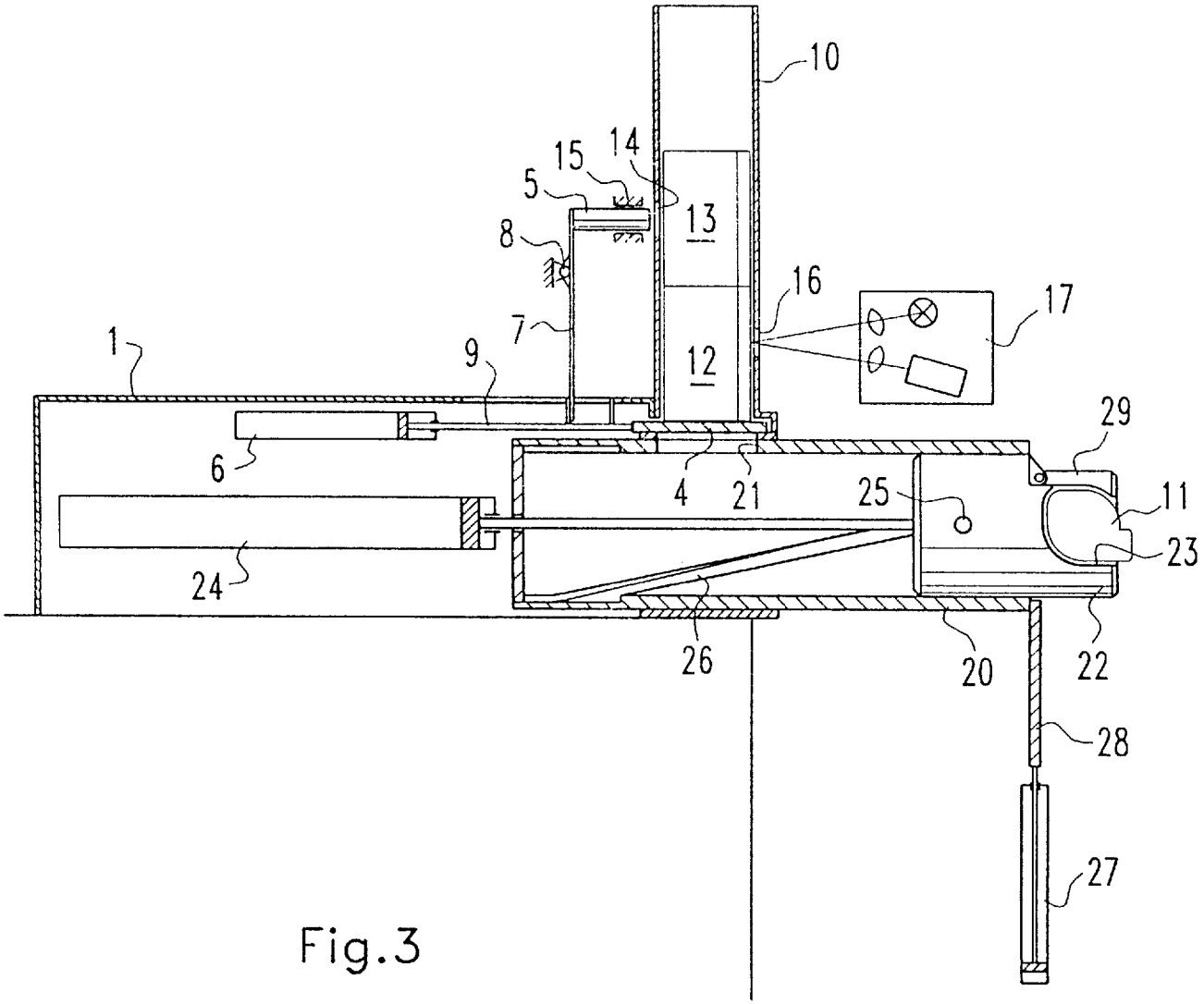
FIG. 3 shows a side view of the device in accordance with FIG. 1, in which the cartridge receptacle has been rotated by 90°, in its end position at the removal station.

Film cartridges 11, 12, 13 are fed from a tube 10, whose shape conforms to the shape of the cartridges. This tube can be designed either as shown in FIGS. 1–3 having a fixed feed shaft, or as a replaceable magazine. In the latter case it would be advantageous to provide the tube at its lower end with an additional locking device or seal, which is not shown. This prevents the cartridges from slipping out downwards when the replaceable magazine is inserted or mounted.

The tube 10 is provided with an opening 14, through which the clamping stamp 5, which is, for example a plunger, guided by friction bearing 15, can act on the cartridges to selectively allow advance downward. An additional opening 16 serves as the reading window for the scanner 17, to allow monitoring of the contents of the tube 10.

Beneath the locking slide 4, a cylindrical tube 20 is provided. This tube includes a feed opening 21 for cartridges 11, 12, 13. A cylindrically shaped sliding carriage 22, with a cartridge receiving chamber 23, is disposed in the tube 20. This sliding carriage 22 is rotatably linked to the piston rod of the pneumatic cylinder 24. Guiding pins 25 are provided within the tube 20 which are attached securely to the carriage, extending into the guide slots 26 of the tube 20.

As shown in the Figures, to keep light out of the interior of the device, the guide slots 26 are designed as partial thickness grooves in the tube's inner wall. In this manner, when the locking slide 4 is open, no light incident on the tube can get through guide slots 26 into the device's interior. However, such a component has high fabrication costs. Therefore, it is advantageous to have the guide slots 26 designed as slots running fully through the wall of the tube 20, which now no longer shuts out incident light. A closed exterior tube can then be placed over tube 20 to form a laminated wall tube, having the same functional properties but with reduced cost of fabrication.

A slide 28, also activated by the pneumatic cylinder 27, is provided in the tube 20. When locking slide 4 is opened, this slide 28 also prevents incident light from coming through the guide shaft 10 into the interior of the device.

The receiving chamber 23 for film cartridges is formed by an appropriately shaped recess in carriage 22, and a flap 29, attached so as to swivel, as shown in FIG. 3. It is advantageous to have this flap 29 be spring-loaded, so that the film cartridges are held clamped in the receiving chamber 23 in a pincers-like manner.

If a filled magazine is slipped on, or if feed shaft 10 is filled with cartridges, then the lowest cartridge 11 is sensed by the scanner 17. A check is performed of whether it contains a roll of film, which can be handled in the same way as the previous films, e.g., whether the film should be processed using the same steps in the same order. If this is the case, then pneumatic cylinder 6 is activated, opening the locking slide 4, while clamping stamp 5 is activated simultaneously by the cams 3 and leaf spring 7 in such a way that it compresses cartridge 12 against the opposite wall of feed shaft 10, thereby holding it securely by frictional forces. If locking slide 4 is completely open, the lowermost film cartridge 11 drops through the opening 21 of tube 20, into the cartridge receiving chamber 23 of carriage 22.

Locking slide 4 is again closed by means of the pneumatic cylinder 6. The clamping of cartridge 12 by clamping stamp 5 is released. This film cartridge and film cartridge 13 that lies above it slide downward in feed shaft 10, until the lower side of cartridge 12 rests on locking slide 4. This condition is depicted in FIG. 2.

Locking slide 4 is shown in its closed position, preventing light from entering the interior of the device, in FIGS. 2 and 3. Therefore, slide 28 can be opened via pneumatic cylinder 27.

Pneumatic cylinder 24, which acts in connection with carriage 22, is then activated. While the carriage moves through tube 20, the cartridge 11 in receiving chamber 23 not only moves in linear fashion, but is simultaneously turned by 90 degrees. This is achieved by the two guiding pins 25 that are attached to the carriage 22 and slide in the guide slots 26 of tube 20. One of the guide slots 26 begins in the manner depicted on the bottom of the left side of the tube 20 and continuously runs via the back side upwards to the middle of the tube 20. The second guide slot 26 begins correspondingly at the top of the left side of the tube 20, and runs via the front side of the tube, here cut off and not depicted, downwards, likewise approximately to the middle of the tube. Thus, the guide slots 26 form a helical cam. When carriage 22 is shifted forwards, the upper guiding pin 25 consequently moves forward out of the plane of the figures as depicted in FIG. 3. The lower guiding pin 25 moves backward into the plane of the figures. In each case they move to the middle of the tube 20. In this way, simultaneous with linear movement of the carriage, and rotation by 90 degrees is achieved.

The final position of carriage 22 is depicted in FIG. 3. The film cartridge here is in its position for removal.

The cartridge is held in this position by a mechanism that is not shown in the figures. While this is occurring, carriage 22 can again be drawn back by action of pneumatic cylinder 24 into its initial position, shown in FIG. 1. While this is taking place, flap 29 is opened briefly. However, it is again moved back into its closed position when the carriage has moved far enough so that the cartridge is outside receiving space 23. As soon as the carriage is back in its initial position, slide 28 is closed by the action of pneumatic cylinder 27. This ensures stray light will not enter the film removal point when locking slide 4 is again opened. Likewise, a mechanism (not described here in detail) is provided that holds flap 29 in this initial position of the carriage, to allow the cartridge to fall into the receiving chamber 23, and subsequently be clamped by the spring loaded flap 29.

As a result of these actions, the device again is in the condition shown in FIG. 1, so that the next cartridge can be fed.

To ensure safe and appropriate functioning of the device, several sensing devices (not depicted here) are arrayed which check the particular conditions and generate messages in the event of possible errors. These sensing devices communicate with a control device which controls the system and generates appropriate messages in the event of any malfunctions.

While the above detailed description has shown, described and pointed out the fundamental novel features of the invention as applied to various embodiments, it will be understood that various omissions and substitutions and changes in the form and details of the device illustrated may be made by those skilled in the art, without departing from the spirit of the invention. Consequently, the full scope of the invention should be ascertained by the appended claims.

What is claimed is:

1. A device for the handling of a film cartridge having a spool axis, comprising:

a cartridge guide for gravitationally feeding the cartridge along its spool axis, the cartridge guide having a cross-section which corresponds to an external shape of the cartridge; and means for turning the cartridge from a position in which the spool axis is aligned approximately vertically to a position in which the spool axis is aligned approximately horizontally, having a cartridge receptacle which is simultaneously linearly displaced and rotated.

2. The device in accordance with claim 1, further comprising a tube having an axis, wherein said cartridge receptacle is guided inside said tube along said tube axis between a receiving position and a position for handling the cartridge.

3. The device in accordance with claim 2, further comprising a groove in a wall of said tube, and a follower attached to said cartridge receptacle for following said groove.

4. The device according to claim 3, wherein said follower comprises a peg, said peg being slidably displaceable along said groove.

5. The device in accordance with claim 3, further comprising an outer jacket around said tube.

6. The device in accordance with claim 2, further comprising a seal located at one end of said tube, having a first, open position and a second, light tight closed position.

7. The device in accordance with claim 2, further comprising a light tight sealable aperture located above said cartridge receptacle in said receiving position.

8. The device in accordance with claim 3, wherein said tube comprises an inner shell having said groove, comprising a slotted aperture, and an outer shell obscuring said slotted aperture.

9. The device in accordance with claim 3, wherein said tube comprises an inner shell having said groove, comprising a plurality of elongated slotted apertures, and an outer shell obscuring said slotted apertures.

10. The device in accordance with claim 3, wherein said groove comprises a helical groove having a quarter turn twist.

11. The device in accordance with claim 9, wherein said plurality of elongated slotted apertures each comprises a helical cam structure on an inner surface of said tube, having two diametrically opposed quarter turn helical twists.

12. The device in accordance with claim 1, wherein said means for turning the cartridge is actuated by a single actuator.

13. The device in accordance with claim 12, wherein said single actuator comprises a linear actuator.

14. The device in accordance with claim 13, wherein said linear actuator comprises a pneumatic actuator.

15. The device in accordance with claim 1, wherein said means for turning the cartridge has a staring position and an ending position, further comprising means for returning said cartridge receptacle from said ending position to said starting position.

16. The device in accordance with claim 1, further comprising a restraining member for selectively restraining the cartridge to said cartridge receptacle.

17. The device in accordance with claim 1, wherein said restraining member selectively restrains the cartridge during displacement and rotation of said means for turning.

* * * * *